US005211137A

United States Patent [19]

Kawauchi et al.

[11] Patent Number: 5,211,137

[45] Date of Patent: May 18, 1993

[54] COOLING SYSTEM FOR A CYLINDER OF AN INTERNAL COMBUSTION ENGINE

[75] Inventors: Masato Kawauchi, Mishima; Masayoshi Tokoro, Susono; Shizuo Abe, Mishima, all of Japan

[73] Assignee: Toyota Jidosha Kabushiki Kaisha, Aichi, Japan

[21] Appl. No.: 893,087

[22] Filed: Jun. 3, 1992

[30] Foreign Application Priority Data

Jun. 10, 1991 [JP] Japan ..... 3-138004

[51] Int. Cl.[5] ..... F02F 1/14

[52] U.S. Cl. ..... 123/41.79; 123/41.83

[58] Field of Search ..... 123/41.72, 41.79, 41.83, 123/41.84

[56] References Cited

U.S. PATENT DOCUMENTS 2,078,499 4/1937 Ljungström ..... 123/41.84

FOREIGN PATENT DOCUMENTS 63-168242 11/1988 Japan .

64-212625 4/1991 Japan .

*Primary Examiner*—Noah P. Kamen

*Attorney, Agent, or Firm*—Oliff & Berridge

[57] ABSTRACT

A cooling system of an internal combustion engine has a plurality of coolant passages located in a row along a longitudinal axial direction of a cylinder liner. Each of the plurality of coolant passages is located so as to extend approximately along a circumference of the cylinder liner. The plurality of coolant passages are located between an inner wall of a cylinder block and an outer wall of the cylinder liner. The cylinder liner is fitted in the cylinder block. The cooling system also has an inflow passage through which coolant flows into the plurality of coolant passages. The cooling system also contains a flux passage through which coolant flows out of the plurality of coolant passages. The inflow passage and the flux passage are arranged such that, the closer a coolant passage is to a combustion chamber end of the engine cylinder, the smaller the pressure loss of coolant flowing through a part of the inflow passage, that coolant passage and a part of the flux passage, the coolant traveling along that part of the inflow passage, that coolant passage and that part of the influx passage.

2 Claims, 7 Drawing Sheets

COOLING SYSTEM FOR A CYLINDER OF AN INTERNAL COMBUSTION ENGINE

BACKGROUND OF THE INVENTION (1) Field of the Invention

The present invention generally relates to a cooling system for an internal combustion engine, and more particularly to a cooling system for cooling a cylinder by means of a coolant which flows in a passage formed on an outer surface of a cylinder liner.

(2) Description of the Related Art

Japanese Laid-Open Utility Modes Application No. 63-168242 discloses a cooling system for cooling an internal combustion engine by passing a coolant through a spiral or ring-shaped passage formed on an outer surface of a cylinder liner.

FIGS. 1A, 1B and 1C are respectively a plan view, a sectional view seen along a line Ib—Ib shown in the FIG. 1A, and a sectional view seen along a line Ic—Ic shown in the FIG. 1A of one example of a prior art cooling system. A plurality of ring-shaped coolant grooves 2 are formed on an outer surface of a cylinder liner 1. In the condition where the cylinder liner 1 is fitted in a bore part formed in a cylinder block 3, coolant passages 4 consist of the coolant grooves 2 and an inner surface 3*a* of the bore part of the cylinder block 3. Further, all of the coolant passages 4 are connected with each other by means of connecting passages 5, 6 extending along a longitudinal axial direction of the cylinder liner 1. Each passage 5, 6 consists of grooves formed on both the outer surface of the cylinder liner 1 and the inner surface 3*a* of the bore part of the cylinder block 3. Both of these connecting passages 5, 6 have the same sectional area. A supply pipe 7 is connected with a bottom end part of the connecting passage 5, and a drain pipe 8 is connected with a top part of the connecting passage 6. Both pipes 7 and 8 are formed in the cylinder block 3.

Coolant flows into the connecting passage 5 via the supply pipe 7 and is distributed into each of the coolant passages 4. The coolant flowing in the coolant passages 4 is exposed to heat from the cylinder liner 1, thus cooling the cylinder liner 1. The coolant is collected in the connecting passage 6 after passing through the coolant passages 4 and then the coolant flows out of the connecting passage 6 via the drain pipe 8.

In a construction of a coolant passage provided for the cylinder liner of a cooling system as shown in the FIGS. 1A through 1C, coolant flows in a parallel manner in each passage of the plurality of ring-shaped passages 4. Pressure loss incurred in the coolant passage of this type is smaller than in a spiral-shaped coolant passage which surrounds the circumference of the cylinder liner so that coolant flows occurs in one direction, from an inflow part to a flux part. Thus, it is possible to minimize a capacity of a discharging pump for circulating coolant through the coolant passages in the construction as shown in the FIGS. 1A through 1C.

FIG. 2 is a graph showing a relation between a position Z of each of the coolant passages 4 in the cooling system shown in the FIGS. 1A through 1C in an axial direction of the cylinder liner 1, and a flow velocity S of coolant flowing in each of the coolant passages 4 which corresponds to a rate of heat transmitted from a wall of the cylinder liner to the coolant.

A broken line A of the FIG. 2 shows a flow velocity distribution of coolant in each of the coolant passages 4 where a diameter of each of the connecting passages 5, 6 is relatively large. A solid line B of the FIG. 2 shows a flow velocity distribution of coolant in each of the coolant passages 4 where a diameter of each of the connecting passages 5, 6 is small.

In the above mentioned first case, relatively small pressure loss of coolant flowing in each of the coolant passages 4 is incurred where the diameter of each of the connecting passages 5, 6 is large. Thus, a flow velocity of coolant in each of the coolant passages 4 is uniform over all positions from a top position to a bottom position as shown in FIGS. 1B and 1C thereof, and as shown by the broken line A of the FIG. 2. On the other hand, in the above mentioned second case, a significant amount of pressure loss of coolant flowing in each of the coolant passages 4 is incurred where the diameter of the connecting passages 5, 6 is small. Thus, a flow velocity distribution of coolant in each of the coolant passages 4 is such that the coolant closer to the passages 4 at a top or bottom end of the cylinder liner as shown in FIGS. 1B and 1C, experiences an increased flow velocity. In a position near a central part of the coolant passages 4 as shown in FIGS. 1B, 1C, a flow velocity of the coolant decreases as shown in the solid line B of the FIG. 2.

Further, FIG. 3 is a graph showing a general relationship between position Z in the cylinder liner along an axial direction thereof and heat quantity Q incoming into the cylinder liner in an operation of the engine. In the graph, the above mentioned relationship is as shown by the line C of the graph. Generally speaking, greater amounts of heat are emitted at positions closer to a combustion chamber end of the cylinder. Thus, the higher positions of the cylinder liner are exposed to greater amounts of heat. Furthermore, lesser amounts of; heat quantity are emitted to positions farther from a combustion chamber end of the cylinder or at the lower position of the cylinder liner.

In a construction of the cooling system for cooling a cylinder liner by coolant circulating along a circumference of the cylinder liner, effective cooling is achieved by cooling to a certain temperature using a proper quantity of coolant. For example, a desired cooling system has a proper heat-transmission rate and a proper heat-transmission area, while allowing for a reduction in size of the engine and minimizing energy used for operation of the engine. However, in the construction of the cooling system 9 as shown in the FIGS. 1A through 1C, the coolant flow velocity S shown in FIG. 2, that is, a distribution of heat-transmission rate, does not coincide with the distribution of the incoming-heat rate Q even if the diameters of the connecting passages 5, 6 are altered. Thus, it is not possible to perform a cooling corresponding to the heat quantity emitted to the cylinder liner. Therefore, a problem may arise in that at one position along the axial length of the cylinder liner 1, a flow velocity of coolant flowing in the coolant passages 4 is so low that the coolant may boil due to insufficient cooling of the cylinder liner 1. At a another position along the axial length of the cylinder liner, a flow velocity of coolant is so high that excessive cooling may result in an increase of energy lost due to friction resulting from movement of a piston therein. Thus, it is not possible to perform cooling effectively.

SUMMARY OF THE INVENTION

The present invention solves the above mentioned problems by providing a cooling system wherein it will be possible to improve cooling ability.

The particular objective of the present invention is to provide a cooling system wherein it will be possible to cool a cylinder liner so that the cooling will correspond to a distribution of heat emitted to different portions of the cylinder liner. The heat distribution is a function of the distance of the cylinder liner from a combustion chamber.

To achieve the particular object of the present invention, a cooling system according to the present invention comprises:

a plurality of coolant passages located in a row along a longitudinal axial direction of a cylinder liner, each passage of the plurality of coolant passages being located so as to extend approximately along a circumferential direction of the cylinder liner, the plurality of coolant passages being located between an inner wall of a cylinder block and an outer wall of the cylinder liner, the cylinder liner being fitted in the cylinder block;

an inflow passage, coolant flowing into the plurality of coolant passages via the inflow passage; and a flux passage, coolant flowing out of the plurality of coolant passages via the flux passage;

the coolant passages extending from the inflow passage to the flux passage;

the inflow passage and the flux passage being arranged such that, the closer to a combustion chamber end of the cylinder a coolant passage is, the smaller the incurred pressure loss of coolant flowing through a part of the inflow passage, that coolant passage and a part of the flux passage, the coolant traveling along that part of the inflow passage, that coolant passage and that part of the influx passage.

In the above construction, it will be possible to cool the cylinder liner so as to correspond to a distribution of heat emitted thereto, because the closer to the combustion chamber end of the cylinder a coolant passage is, the higher the flow velocity of coolant flowing in the coolant passage. Thus, effective cooling will be possible.

Other objects, features and advantages of the present invention will become more apparent from the following detailed description when read in conjunction with the accompanying drawings in which.

DESCRIPTION OF THE PREFERRED EMBODIMENT

Figure 4A:
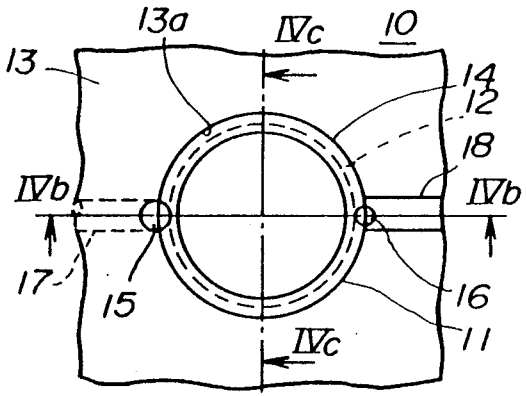
FIGS. 4A, 4B and 4C respectively show a construction of a first embodiment of a cooling system according to the present invention.
Figure 4B:
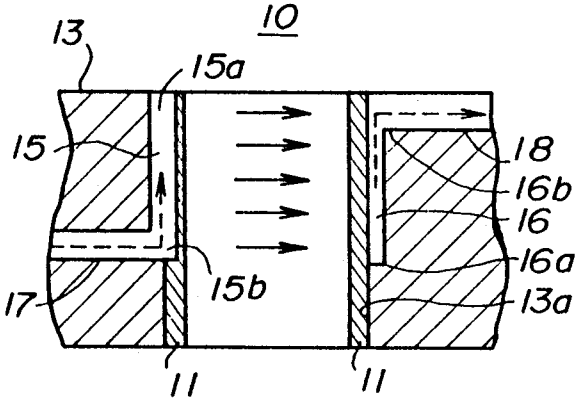
Figure 4C:
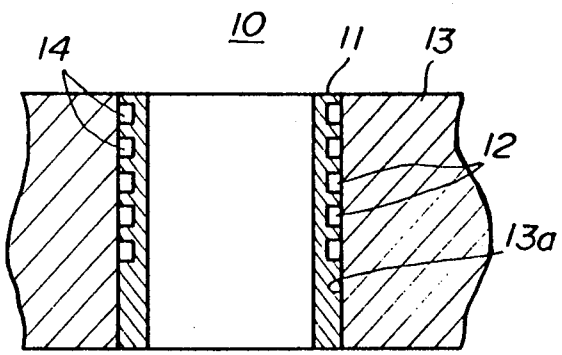

FIGS. 4A, 4B and 4C are respectively a plan view, a sectional view seen along a line IVb—IVb, and sectional view seen along a line IVc—IVc of the first embodiment of a cooling system according to the present invention.

In the drawings, the first embodiment of the cooling system has generally the same construction as that of the cooling system 9 as shown in the FIG. 1. In an outer surface of a cylinder liner 11, a plurality of ring-shaped cooling grooves 12 are formed so that a plurality of coolant passages 14 consist of the plurality of grooves 12 and an inner surface 13*a* of a bore part of a cylinder block 13. Further, all of the coolant passages 14 are connected with each other by means of connecting passages 15, 16 extending along a longitudinal axial direction of the cylinder liner 11, each of which passages 15, 16 consists of grooves respectively formed on both the outer surface of the cylinder liner 11 and the inner surface 13*a* of the bore part of the cylinder block 13. A supply pipe 17 is connected with a bottom end part of the connecting passage 15, and a drain pipe 18 is connected with a top part of the connecting passage 16. Both pipes 17 and 18 are formed in the cylinder block 3.

Coolant flows into the connecting passage 15 via the supply pipe 17, and is distributed into each of the coolant passages 14. The coolant flowing in the coolant passages 14 is exposed to heat emitted from the cylinder liner 11. The cylinder liner 11 is thereby cooled by the coolant. The coolant is then collected in the connecting passage 16 after passing through the coolant passages 14 and then the coolant flows out of the connecting passage 16 via the drain pipe 18.

In the construction of the first embodiment shown in the FIGS. 4A through 4C of the cooling system 10, the connecting passage 15 has a relatively large sectional area so that a pressure loss incurred in the passage 15 will be relatively small in contrast to a pressure loss incurred in each of the coolant passages 14. Thus, a pressure loss of coolant flowing though the connecting passage 15, from a position connected with supply pipe 17 up to a top end position as in the FIG. 4B, is almost '0' (zero).

On the other hand, the connecting passage 16 located in an outlet side has a such a small sectional area that a significant pressure loss, described later, will be incurred during flow of the coolant in the connecting passage 16. The coolant flows from a connecting point 16*a* up to a connecting point 16*b*. The connecting point 16*a* is located in a bottom part of the connecting passage 16. The connecting point 16*a* connects the coolant passages 14 with the connecting passage 16. The connects point 16*b* connecting the connecting passage 16 with the drain pipe 18.

Figure 5:
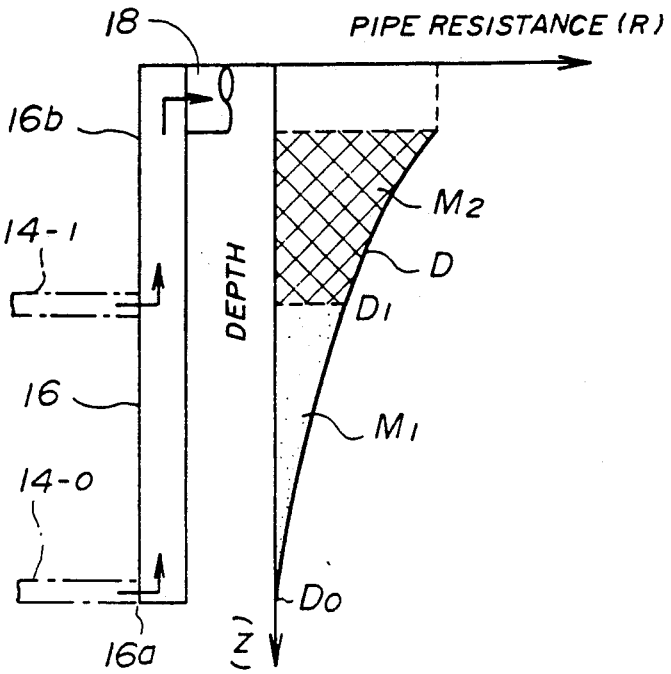
FIG. 5 is a graph showing a pipe resistance and a pressure loss in an outlet-side connecting passage in the system shown in the FIGS. 4A through 4C.

FIG. 5 is a graph showing pipe resistance R and pressure loss M in the connecting passage 16 between the above mentioned connecting points 16*a*, 16*b* shown in the FIGS. 4A through 4C.

A flow velocity of coolant flowing in the connecting passage 16 is such that the nearer to the drain pipe 18 that a coolant position in the connecting passage 16 is, the higher the flow velocity of the coolant flowing therein is. Coolant flowing in each of the coolant passages 14 flows into the connecting passage 16 and the coolant flowing into the connecting passage 16 flows into the drain pipe 18. Generally speaking, resistance to flow (hereinafter pipe resistance) of straight pipe is in proportion to a value obtained by squaring the flow velocity of the fluid. A pipe resistance R of the connecting passage 16 becomes generally that shown by a curved line D of the FIG. 5. The line D follows to the above mentioned square-law-characteristics.

Also, a pressure loss of coolant flowing in the connecting passage 16 is indicated in a dotted area $M_1$ and a latticed area $M_2$ shown in the FIG. 5. Therefore, coolant flowing into the connecting passage 16 from an intermediate coolant passage $\mathbf{14}_{-1}$, shown in the FIG. 5, incurred pressure loss corresponding to the pressure loss $M_2$, shown in the FIG. 5, during flow in the connecting passage 16 until the coolant flows into the drain pipe 18. On the other hand, coolant flowing into the connecting passage 16 from a bottom part of coolant passage $\mathbf{14}_{-0}$, shown in the FIG. 5, will flow in the connecting passage 16 until the coolant flows into the drain pipe 18 and incur an amount of pressure loss corresponding to a result obtained by adding together the pressure losses $M_1$ and $M_2$ shown in the FIG. 5. In the examples mentioned above, a pressure loss incurred by coolant flowing in the connecting passage 16, is such that the higher the location of the connection between the coolant passage 14 and the connecting passage 16, the smaller the pressure loss incurred by the coolant flowing in the connecting passage 16 up to the above mentioned connecting point 16*b*. Each of the coolant passages 14 is located in a plane perpendicular to a longitudinal axial direction of the cylinder liner 11. Each of the coolant passages 14 is separated from the others along a column extending along the axial direction of the cylinder liner.

Also, in the cooling system 10 as shown in the FIGS. 4A through 4C, all of the coolant passages 14 are made the same, thus pressure loss of coolant flowing in each of the coolant passages 14 is the same. Further it is possible, in the connecting passage 15, to reduce pressure loss of coolant flowing therein to almost '0' (zero). However, in the cooling system 10, if coolant flows in a coolant passage course including a series of passages comprising the supply pipe 17,. the connecting passage 15, each of the coolant passages 14 including the uppermost, middle and lowermost passages, the connecting passage 16, and the drain pipe 18, differences in pressure losses incurred in the above mentioned coolant passage courses caused by differences in pressure losses incurred in the connecting passage 16. For example, if coolant flows through only the uppermost passage of the coolant passages 14, a very small part of the passage 16 is used and almost no pressure loss occurs. If the course includes the lowest passage of the coolant passages 14, almost all, of the passage 16 is used and the pressure loss is greatest.

Figure 3:
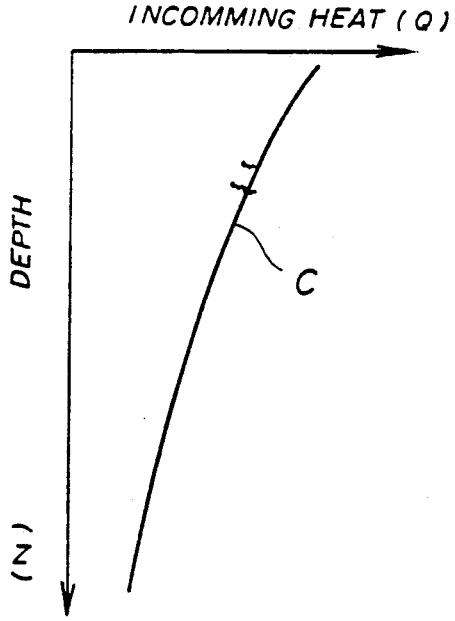
FIG. 3 PRIOR ART
FIG. 3 is a prior art graph showing a general distribution of a heat given to a cylinder liner during an operation of an engine.

That is, the higher a position of the coolant passages 14 is, the easier coolant therein flows, and the lower the position of the coolant passages 14 is, the more difficultly coolant therein flows. Therefore, a flow velocity distribution of coolant in each of the coolant passages 14, that is, a distribution of heat-transmission rate of coolant, becomes such that, as shown by a line $E_1$ of FIG. 6, the higher a position of the coolant passages 14, the higher a value of flow velocity corresponding to the position. Thus, the distribution becomes as shown in the line $E_1$ of the FIG. 6 so as to correspond to the distribution of the incoming heat quantity as shown in the FIG. 3.

In summarizing the above mentioned description of the first embodiment of the cooling system 10, the construction is such that the connecting passage 16 located at an outlet side has a small sectional area so that a significant pressure loss is incurred by coolant flowing therein. Therefore, it will be possible to make a distribution of a flow velocity of coolant flowing in each of the connecting passages 14 correspond to a distribution of heat quantity emitted to the cylinder liner. As a result, it is possible to prevent not only excessive cooling but also boiling of coolant due to lack of cooling. It is also possible to perform effective cooling of the cylinder liner and to minimize a capacity of a circulating pump in an internal combustion engine.

Figure 7A:
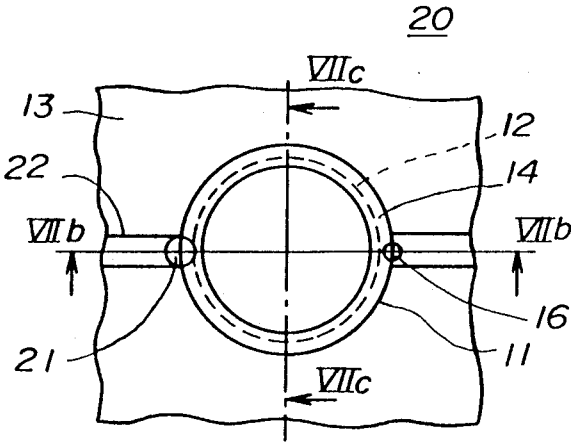
FIGS. 7A, 7B and 7C respectively show a construction of the second embodiment of a cooling system according to the present invention.
Figure 7B:
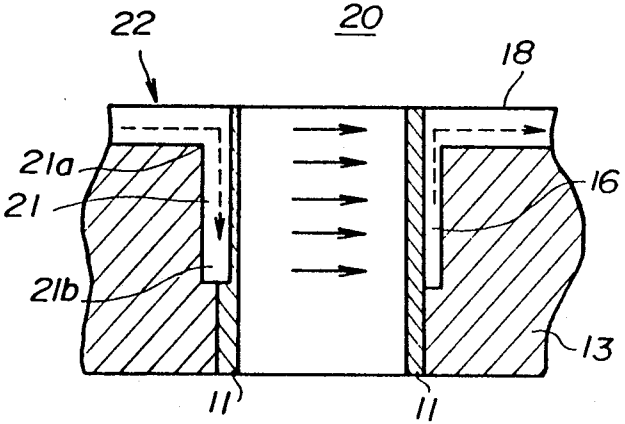
Figure 7C:
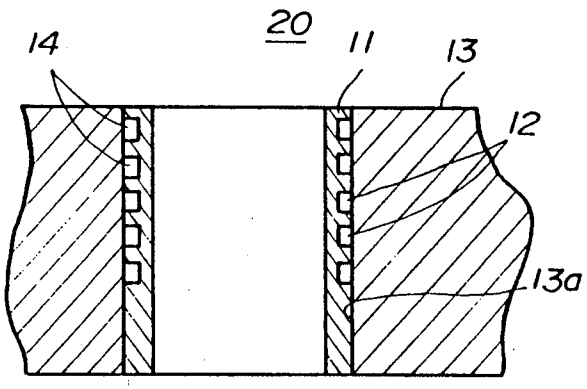

FIGS. 7A, 7B and 7C are respectively a plan view, a sectional view seen along a line VIIb—VIIb, and sectional view seen along a line VIIc—VIIc of the second embodiment of a cooling system according to the present invention.

All construction of the cooling system 20 as shown in the drawing is the same as the construction of first embodiment of the cooling system 10 as shown in the FIGS. 4A through 4C, except that a supply pipe 22, which is a coolant inlet, is connected with a top end part of a connecting passage 21 located at an inlet side. In FIGS. 4A through 4C, the supply pipe 17 is connected with the bottom end part of the connecting passage 15 located at an inlet side. Thus, the same numerals given to respective parts in the system 20 are given to respective parts in the system 10, and a description of the parts will be omitted.

The connecting passage 21 located at an inlet side of the cooling system 20 has a relatively large sectional area as in the connecting passage 15 of the above mentioned cooling system 10, so that a pressure loss of coolant flowing in the connecting passage 21 is relatively small in contrast to a pressure loss of coolant flowing in each of coolant passages 14. Therefore, a pressure loss of coolant flowing in the connecting passage 21, from a point where coolant flows into the passage 21 from the supply pipe 22, becomes almost '0' (zero).

Therefore, in the cooling system 20 of the first embodiment, which is almost the same as the cooling system 10 of the second embodiment, if coolant flows in a coolant passage course including a series of passages comprising the supply pipe 22, the connecting passage 21, each of the coolant passages 14, a connecting passage 16 and a drain pipe 18, differences in pressure incurred in the above mentioned coolant passage courses are caused by differences in pressure losses incurred in a certain parts of the connecting passage 16. These pressure differences are caused by differences in the amount of distance within the passage 16 coolant travels, as mentioned in the description of the cooling system 10. Thus, the higher the position of the coolant passages 14, the easier coolant flows therein. Therefore, in the cooling system 20, a flow velocity distribution of coolant in each of the coolant passages 14, that is, a distribution of heat-transmission rate of coolant, is such that the higher, the position of the coolant passages 14, the higher the value of flow velocity of coolant. Also, the higher the position of coolant passages, the larger the heat-transmission quantity. Thus, the same advantages as obtained in the system 10 can be obtained in the system 20.

However, in the system 20, a coolant passage course for coolant flowing into the uppermost passage of the coolant passages 14 does not include a turning position 21*a* as shown in the FIG. 7B. In the turning position 21*a*, a flow of coolant is turned 90 degrees from a transverse direction, as shown in FIG. 7B, of the supply pipe 22 into a longitudinal direction of the connecting passage 21. During this turning in position 21*a*, the coolant incurs a large pressure loss. Thus, it becomes easy for coolant to flow into the uppermost passage of the coolant passages 14 from the supply pipe 21 in contrast to the system 10 because a coolant passage course for coolant flowing into the uppermost passage of the passages 14 includes a turning point 15*a* at a top part of the connecting passage 15, as shown in the FIG. 4B. Also, in the system 20, a coolant passage course for coolant flowing into the lowest passage of the coolant passages 14 includes a turning position 21*b* at a bottom end part of the connecting passages 21 shown in the FIG. 7B. Thus, it becomes difficult for coolant to flow into the lowest passage of the passages 14 from the connecting passage 21 in contrast to the system 10, because coolant flow into the lowest passage of the passages 14 does not include a turning point 15*b* in a bottom part of the connecting passage 15 as shown in the FIG. 4B.

Figure 6:
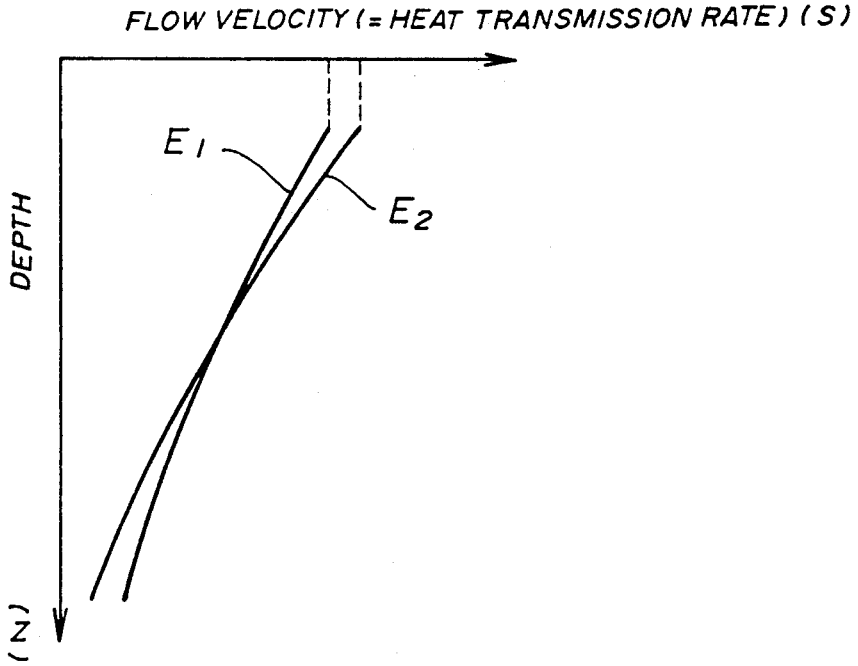
FIG. 6 is a graph showing distributions of a flow velocity of coolant respectively in the first embodiment and a second embodiment of cooling systems according to the present invention.

Therefore, a property in the system 10 is further enhanced in the system 20 as shown in a line $E_2$ of FIG. 6. This property is that the higher the position of the passages 14, the higher the flow velocity of coolant flowing at that position, and the larger the heat quantity transmitted from that position.

Figure 8A:
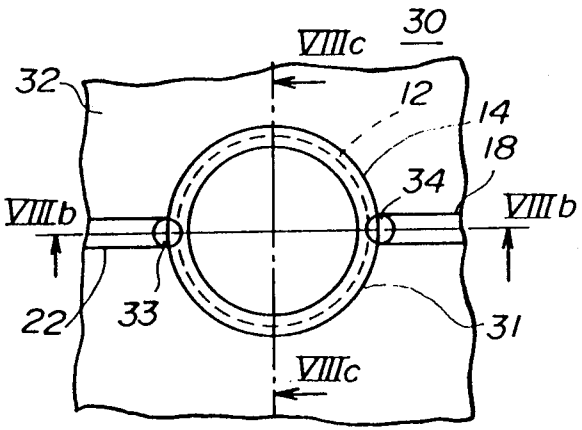
FIGS. 8A, 8B and 8C respectively show a construction of a third embodiment of a cooling system according to the present invention.
Figure 8B:
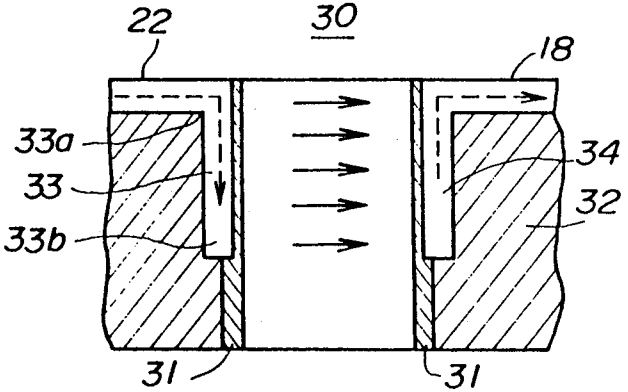
Figure 8C:
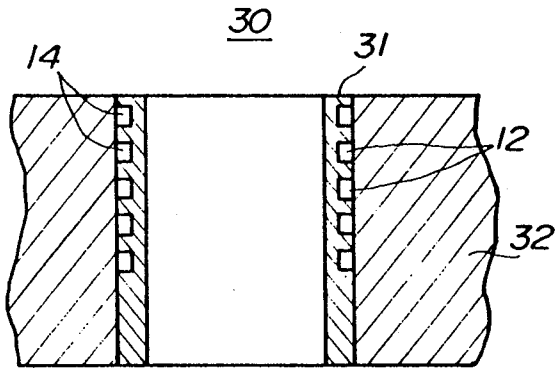

FIGS. 8A, 8B and 8C are respectively a plan view, a sectional view seen along a line VIIIb—VIIIb, and sectional view seen along a line VIIIc—VIIIc of the third embodiment of a cooling system according to the present invention.

All construction of the cooling system 30 as shown in the drawings is the same as the construction of the second embodiment of the cooling system 20 as shown in the FIGS. 7A through 7C, except for sectional areas of connecting passages 33 and 34. Each of these passages consists of grooves formed on both a cylinder liner 31 and a cylinder block 32. Thus, the same numerals given to respective parts in the system 30 are given to respective parts in the system 20, and a description of the parts will be omitted.

In the cooling system 30, the passage 33 is located at an inlet side and the passage 34 is located at an outlet side. The connecting passages 33, 34 have the same small sectional area so that coolant flowing in the passages 33 and 34 incurs significant pressure losses.

In the system 30 having the construction of the connecting passages 33, 34 mentioned above, coolant flowing in the connecting passage 33 before flowing into each of coolant passages 14 incurs a certain pressure loss, and coolant flowing in the connecting passage 34 after flowing out of each of coolant passages 14 incurs a certain pressure loss. Thus, in the cooling system 30, as in the cooling system 20, if coolant flows in a coolant passage course including a series of passages comprising a supply pipe 22, the connecting passage 33, each of the coolant passages 14, the connecting passage 34 and a drain pipe 18, the higher the position of the cooling passages 14, the position being included in the coolant passage course, the smaller the pressure loss incurred by coolant flowing in the series of passages and the easier the coolant flows. The lower the position of the cooling passages 14, the position being included in the series of passages, the larger the pressure loss incurred by coolant flowing in the series of passages and the more difficult it is for the coolant to flow therein.

Figure 9:
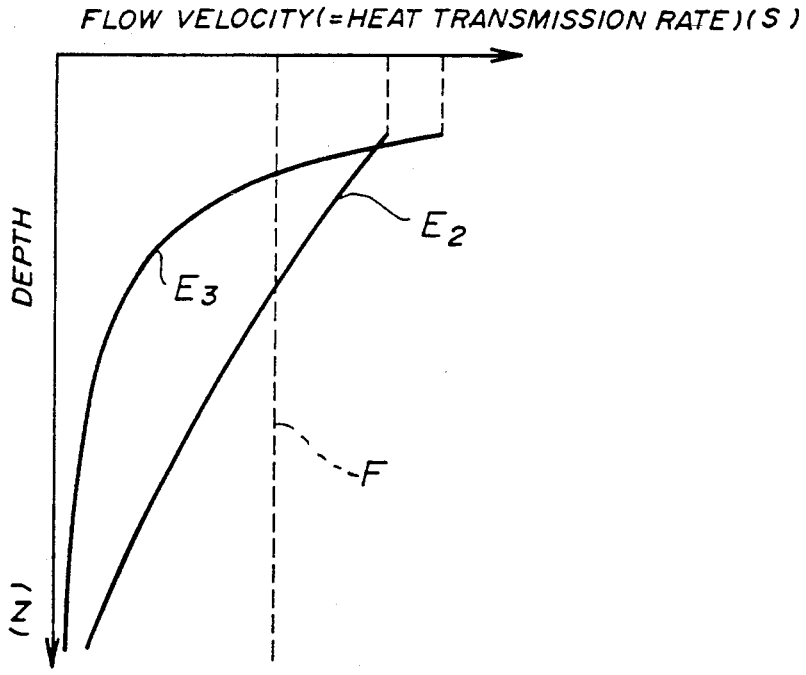
FIG. 9 is a graph showing distributions of a flow velocity of coolant in the third embodiment of cooling systems according to the present invention.

In the cooling system 30, a coolant passage course for coolant flowing into passages adjacent to the top of the cylinder liner 31, as shown in the FIG. 8B, via the connecting passage 33 does not include a turning point 33*a* because the supply pipe 22 is connected with a top part of the connecting passage 33. Thus, it is easy for coolant to flow into the passages located adjacent to the top of the cylinder liner 31 without incurring a pressure loss in the turning point 33*a*. Further, in contrast to the system 10, in the system 30, higher the position of the coolant passages 14, the position being included in a coolant passage course including a series of passages, the easier coolant flows in the series of passages. This is because coolant incurs pressure loss in both of the connecting passages 33, 34 located at inlet and outlet sides respectively in the system 30. In contrast, in the system 10, coolant incurs pressure loss in only the connecting passage 16 located at an outlet side. Therefore, by connecting the supply pipe 22 with the top of the connecting passage 33 creating a coolant pressure loss in both of the connecting passages 33, 34, a difference between the values of the flow velocities or heat quantities is large. Each of these values corresponds to an upper position of the passages 14, and a lower position thereof. The difference in the values mentioned above is shown by a line $E_3$ of the FIG. 9 in contrast to the line $E_2$ of the FIG. 9 which shows the difference in values of the system 20. The difference in values of the system 30 ($E_3$) is larger than the difference in values of the system 20 ($E_2$). The difference between line E2 and E3 is because coolant incurs pressure loss only in the coolant passage 16 located at an outlet side in the system 20, while coolant incurs pressure loss in both the coolant passage 33 located at the inlet side and the coolant passage 34 located at the outlet side in the system 30.

Thus, in the system 30, the higher the position of the passages 14, the higher the flow velocity of coolant flowing therein, and the greater the heat quantity transmitted from the cylinder liner adjacent thereto. Therefore, in the system 30, it is possible to perform cooling so as to make the distribution of the flow velocity of coolant approximately equal to the distribution of the heat quantity coming into the cylinder liner as shown in the FIG. 3. It is then possible to obtain the same advantages as obtained in the system 10 of the first embodiment.

Figure 1A:
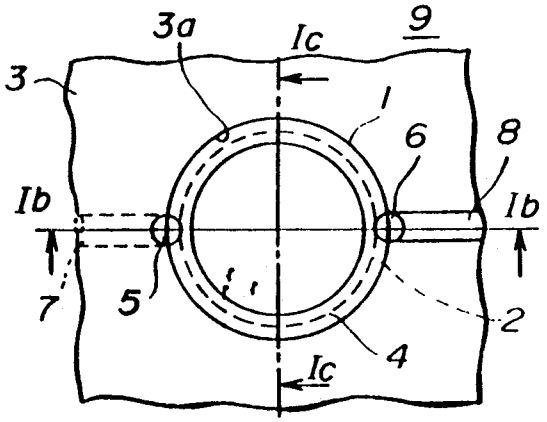
FIG. 1A PRIOR ART
FIGS. 1A, 1B, and 1C respectively show a construction of one example of a prior art cooling system.
Figure 1B:
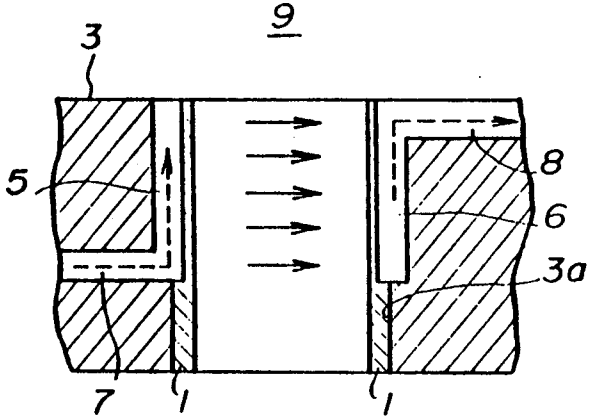
FIG. 1B PRIOR ART
Figure 1C:
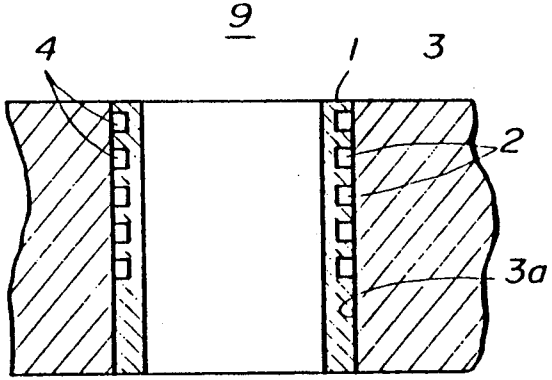
FIG. 1C PRIOR ART
Figure 2:
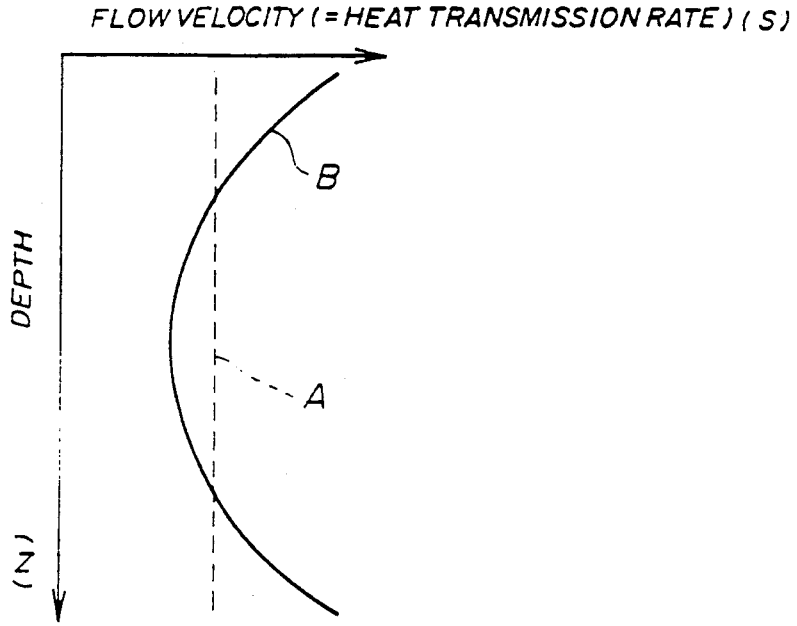
FIG. 2 PRIOR ART
FIG. 2 is a graph showing a flow velocity of coolant in the prior art cooling system shown in the FIGS. 1A through 1C.

Further, in the system 30, if the sectional areas of the connecting passages 33, 34 are made sufficiently large, as those in the related system 9 shown in FIGS. 1A through 1C, a flow velocity of coolant is more uniform in all of the passages 14. The passages are included in a coolant passage course including a series of passages of the coolant as shown by a broken line F of the FIG. 9. Therefore, it is possible to control a distribution of a flow velocity of coolant so that it is between that shown in the solid line $E_3$ of the FIG. 9 and that shown in the broken line F thereof. This control is accomplished by adjusting each of the sectional areas of the connecting passages 33, 34 between a smaller sectional area and a relatively large sectional area as needed.

In summarizing the above mentioned description, in the systems 10, 20 and 30, the higher the position of the passages 14 which is included in a coolant passage course, the higher the flow velocity of the coolant. Also, the closer the coolant position is to the combustion chamber end of the cylinder, the higher the flow velocity. Thus, by this construction it is possible to improve cooling ability. Therefore, it is possible to make the cooling capability for cooling the cylinder liner coincide with the distribution of heat emitted to the cylinder liner as shown in the FIG. 3. Further, it is possible to control the distribution of cooling ability for cooling the cylinder liner in various manners, as shown in various graphs, by changing a position where the supply pipe is connected with the connecting passage, and by changing sectional areas of the connecting passages. Thus, it is possible to make a cooling system apply to various kinds of engines which respectively have various properties of distributions of heat coming into cylinder liners from combustion chambers.

In other words, in the systems according to the present invention, it is possible to make the cooling correspond to a distribution of heat emitted to a cylinder liner from a combustion chamber. The distribution of heat emitted to the cylinder liner is such that the closer a coolant position is to the combustion chamber end of the cylinder, the larger the heat quantity emitted thereto; and the further a coolant position is from the combustion chamber end of the cylinder, the smaller the heat quantity emitted thereto. This distribution occurs because the cooling ability of the cooling systems for cooling the cylinder liner is such that the closer the coolant passage is to the combustion chamber end of the cylinder, the larger the flow velocity of the coolant and the higher the cooling ability thereof.

As a result, a minimum capacity circulating pump can be used in the cooling system for circulating coolant. By means of this pump, it is possible to prevent not only excessive cooling but also boiling of coolant caused by lack of coolant. Thus, effective cooling of the cylinder liner in the cooling system is achieved. Therefore, the cooling systems according to the present invention will allow for a significant reduction in the overall size of internal combustion engines and apparatuses including internal combustion engines and contribute to saving energy during operation thereof.

Further, the present invention is not limited to these preferred embodiments, and various variations and modifications may be made without departing from the scope of the present invention.

What is claimed is:

1. A cooling system for an internal combustion engine comprising:

an engine cylinder having a combustion chamber end, a cylinder block and a cylinder liner fitted within said cylinder block;

a plurality of coolant passages located in a row along a longitudinal axial direction of said cylinder liner, each of said plurality of coolant passages being located so as to extend approximately along a circumference of said cylinder liner, said plurality of coolant passages being located between an inner wall of said cylinder block and an outer wall of said cylinder liner;

an inflow passage through which coolant flows into said plurality of coolant passages;

a flux passage through which coolant flows out of said plurality of coolant passages;

a supply passage connected to said inflow passage for introducing coolant thereto;

said inflow passage is located so as to extend approximately along a longitudinal axial direction of said cylinder liner, said supply passage being connected to said inflow passage at a position located near to a farthest one of said coolant passages from said combustion chamber end, said inflow passage having a sectional area large enough so that a pressure loss of coolant flowing in said inflow passage is negligible in contrast to a pressure loss of coolant flowing in each passage of said plurality of coolant passages; and said flux passage is located so as to extend approximately along a longitudinal axial direction of said cylinder liner, said flux passage having a withdrawal outlet at a position located near the closest one of said plurality of coolant passages to said combustion chamber end, said flux passage having a smaller sectional area than that of said inflow passage.

2. A cooling system for an internal combustion engine comprising:

an engine cylinder having a combustion chamber end, a cylinder block and a cylinder liner fitted within said cylinder block;

a plurality of coolant passages located in a row along a longitudinal axial direction of said cylinder liner, each of said plurality of coolant passages being located so as to extend approximately along a circumference of said cylinder liner, said plurality of coolant passages being located between an inner wall of said cylinder block and an outer wall of said cylinder liner;

an inflow passage through which coolant flows into said plurality of coolant passages;

a flux passage through which coolant flows out of said plurality of coolant passages;

a supply passage connected to said inflow passage for introducing coolant thereto;

said inflow passage is located so as to extend approximately along a longitudinal axial direction of said cylinder liner, said supply passage being connected to said inflow passage at a position located near to a closest one of said plurality of coolant passages to said combustion chamber end, said inflow passage having a sectional area large enough so that a pressure loss of coolant flowing in said inflow passage is negligible in contrast to a pressure loss of coolant flowing in each of said plurality of coolant passages; and said flux passage is located so as to extend approximately along a longitudinal axial direction of said cylinder liner, said flux passage having a withdrawal outlet at a position located near to the closest one of said plurality of coolant passages to said combustion chamber end, said flux passage having a smaller sectional area than that of said inflow passage.

* * * * *